United States Patent [19]

Watanabe et al.

[11] Patent Number: 5,048,929

[45] Date of Patent: Sep. 17, 1991

[54] METHOD AND APPARATUS FOR FORMING CURVED SURFACE

[75] Inventors: Junji Watanabe; Tadao Saitoh, both of Tokyo; Kazuo Matsunaga, Kanagawa, all of Japan

[73] Assignee: Nippon Telegraph and Telephone Corporation, Tokyo, Japan

[21] Appl. No.: 385,255

[22] Filed: Jul. 25, 1989

[30] Foreign Application Priority Data

Jul. 26, 1988 [JP] Japan ..... 63-184751
Jul. 27, 1988 [JP] Japan ..... 63-185357

[51] Int. Cl.[5] ..... G02B 27/00

[52] U.S. Cl. ..... 359/896; 425/268; 51/50 R; 359/900; 359/642; 385/85

[58] Field of Search ..... 350/321, 320, 417; 425/72.1, 72.2, 193, 228, 230, 267, 268, 382.3, 469, 470, 471; 51/50 R, 105 LG, 105 R, 105 SP, 106 LG, 108 R, 165.72

[56] References Cited

U.S. PATENT DOCUMENTS 3,037,330 6/1962 Weigand ..... 51/165.72
4,656,787 4/1987 Ueda et al. ..... 51/50 R

OTHER PUBLICATIONS

Highly Stable Low-Insertion- and High-Return-Loss PC Optical Fiber Connector by T. Shintaku et al., Proceedings of 14th European Conference on Optical Communication, 1988, pp. 599-602.

Manufacturing Techniques of a Convex-Curved Optical Connector and its Reliability by Y. Kakutani, Proceedings of 10th Australian Conference on Optical Fiber Technology, 1985, pp. 57-66.

An Automatic Processing Machine for Optical-Fiber Connectors by T. Karaki -Doy et al., Proceedings of the 6th International Conference as Production Engineering, 1987, pp. 563-568.

*Primary Examiner*—Loha Ben

*Attorney, Agent, or Firm*—Blakely, Sokoloff, Taylor & Zafman

[57] ABSTRACT

In a method and apparatus for forming a curved surface, a polishing plate consisting of a film-like elastic member is supported at two positions, i.e., central and peripheral portions thereof, and is rotated while two cylinders having different heights and diameters are urged upward against portions between the central and peripheral portions of the polishing plate, and an object to be processed is urged downward against a surface formed between the two cylinders while the object is rotated, thereby forming a curved surface.

31 Claims, 5 Drawing Sheets

METHOD AND APPARATUS FOR FORMING CURVED SURFACE

BACKPOLISHED OF THE INVENTION

The present invention relates to a method and apparatus for forming a curved surface.

Various conventional methods have been employed to form a curved surface on an end face or an edge of a member or on a member itself. Since a desired curved surface is formed after a plurality of manufacturing steps, processing is complicated and requires a long period of time. Therefore, reduction in manufacturing cost of products is undesirably limited. In addition, the cost of a processing apparatus is high.

When, for example, optical fibers are connected to each other, according to typical conventional connecting methods which have been employed so far, the surfaces of end faces of two fibers to be connected are processed into curved surfaces, and forces are applied from both the fibers toward the connecting portion while both the curved surfaces oppose each other, thereby connecting the fibers. Such a technique is disclosed in, e.g., "Highly Stable Low-Insertion and High-Return Loss PC Optical Fiber Connector" by T. Shintaku et al. Processings of 14th European Conference on Optical Communication, 1988, pp. 599–602.

Such a curved surface formed on a fiber end face is required to be a convex-curved surface having a curvature radius of 10 to 25 mm, a convex vertex eccentricity of 50 μm or less, and a level difference of 0.05 μm or less between a fiber and a ferrule.

In order to satisfy this requirement, a fiber-containing ferrule end face having a flat end is ground by a diamond polishing wheel into a conical shape, and the end of the conical surface is processed into a curved surface by a film polisher, which is stretched like a drum, and diamond slurry. Such a technique is disclosed in, e.g., "An Automatic Processing Machine for Optical-Fiber Connectors" by T. Karaki, J. Watanabe, T. Saitoh, and K. Matsunaga, Processing of the 6th International Conference on Production Engineering, 1987, pp. 563–568.

This method, however, requires two types of machines. In addition, cumbersome processes are required as follows. After a fiber member is set in a grinder and processed, the member is detached from the grinder. The ground end of the fiber member is then cleaned. The fiber member is set in a polisher, and a finishing process of the curved surface is performed. The process sequence is completed upon cleaning of the processed member.

SUMMARY OF THE INVENTION

It is, therefore, a principal object of the present invention to provide a method by which a curved surface can be formed on a member with high precision, using a single apparatus in a single process, and a manufacturing apparatus therefor.

It is another object of the present invention to provide a method of accurately and easily forming a curved surface on a member so as to reduce the manufacturing cost of the member, and a manufacturing apparatus therefor.

In order to achieve the above objects, according to the present invention, a conventional finishing process is improved to allow polishing and working to be performed in a single process, i.e., to allow a single apparatus to form a curved surface on a member.

Therefore, according an aspect of the present invention, there is provided a method of forming a curved surface, wherein a polishing plate consisting of a film-like elastic member is supported at two positions, i.e., central and peripheral portions thereof, and is rotated while two cylinders having different heights and diameters are urged upward against portions between the central and peripheral portions of the polishing plate, and an object to be processed is urged downward against a surface formed between the two cylinders while the object is rotated thereby forming a curved surface.

According to another aspect of the present invention, there is provided an apparatus for forming a curved surface, comprising a polishing plate consisting of a film-like elastic member, a rotary plate for supporting a peripheral portion of the polishing plate, two cylinders arranged on the rotary plate and having different heights and diameters, means for spring-biasing a central portion of the polishing plate downward, and rotating means for rotating an object to be processed and urging the object against the polishing plate, thereby a curved surface is formed on the object.

DESCRIPTION OF THE PREFERRED EMBODIMENTS

Figure 1:
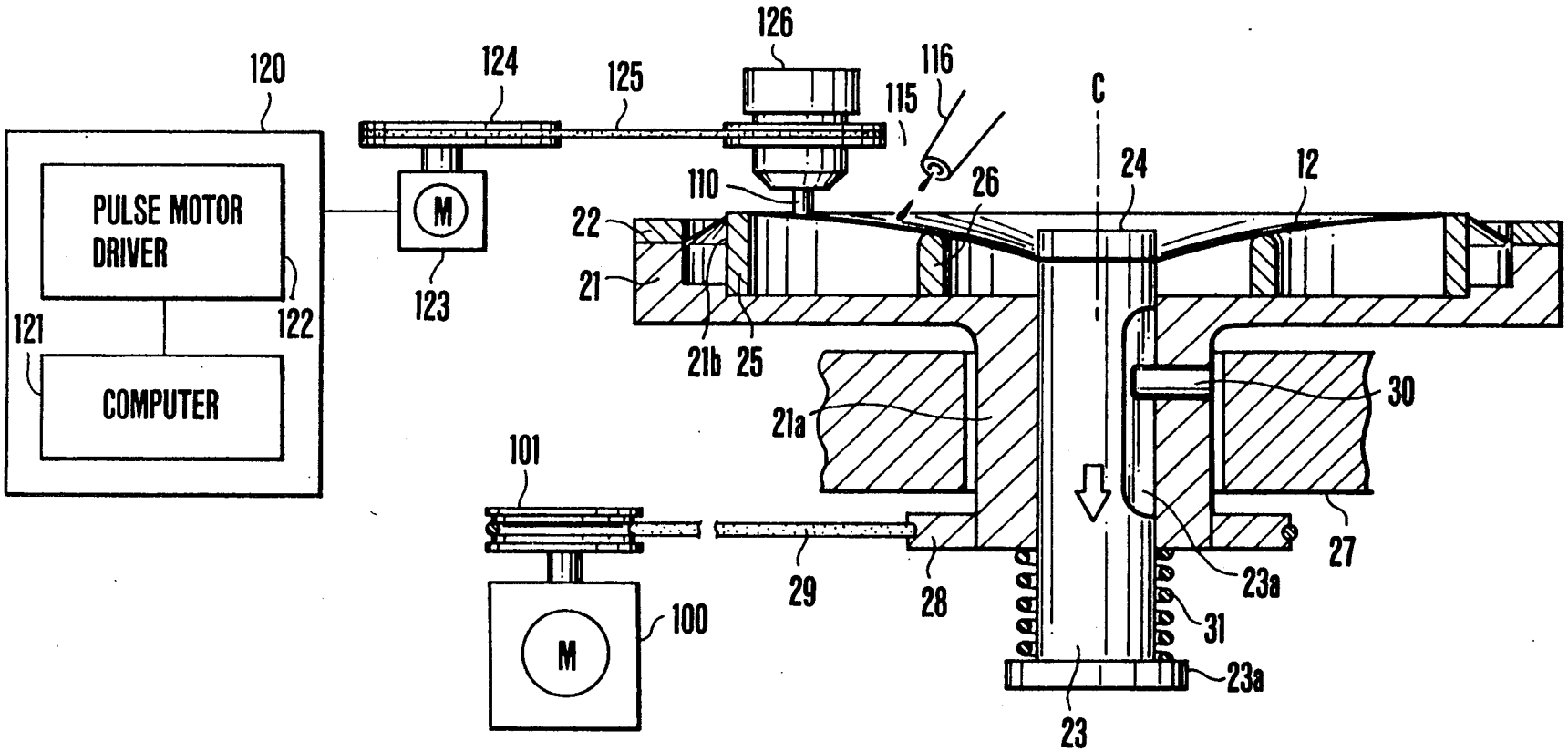
FIG. 1 is a view showing a schematic arrangement of a processing apparatus according to an embodiment of the present invention.

FIG. 1 shows a curved surface forming apparatus according to an embodiment of the present invention, more specifically a polishing apparatus for processing an end face of an optical fiber into a curved surface. Referring to FIG. 1, a polishing plate 12 consists of a film-like elastic member. A peripheral portion of the polishing plate 12 is fixed on a vertical flange formed on a peripheral portion of a rotary base 21 together with a stationary ring 22. In this case, the peripheral portion of the plate 12 is fixed to the peripheral portion of the rotary base 21 by screws or an adhesive agent. A shaft portion 21*a* in which a shaft hole for storing a tension applying shaft 23 is formed is formed in a central portion of the rotary base 21. Outer and inner cylinders 25 and 26 having different diameters are concentrically arranged on an upper surface surrounded by the vertical flange formed on the peripheral portion of the rotary base 21. In this embodiment, the position of the outer cylinder 25 is physically defined by a positioning level difference 21*b* formed on the upper surface of the rotary base 21. However, the inner cylinder 26 may also be positioned by a level difference or a groove formed in the rotary base 21.

The tension applying shaft 23 is fixed at the center of the polishing plate 12 by a central fixing plate 24. A flange 23*a* is formed on the shaft 23 at a position corresponding to the lower end of the shaft portion 21*a*. A coil spring 31 is arranged between the flange 23*a* and the lower end face of the shaft portion 21*a*. An axis c of the shaft 23 and the outer and inner cylinders 25 and 26 are coaxially arranged.

In this case, the length (height) of the outer cylinder 25 is set to be different from that of the inner cylinder 26. In this embodiment, the outer cylinder 25 is higher than the inner cylinder 26. Therefore, as is apparent from FIG. 1, the polishing plate 12 is tightly stretched while descending toward the centripetal direction, i.e., inclined in the form of a V or earthenware-like shape. The outer and inner cylinders 25 and 26 freely support the polishing plate 12 from the lower direction. The shaft portion 21*a* of the rotary base 21 is rotatably supported by a bearing 27. The shaft portion 21*a* is coupled to the shaft of a motor 100 through a pulley 28 mounted on the lower end of the shaft portion 21*a* and a belt 29 looped around the pulley 28 and a pulley 101. A long groove 23*a* is axially formed in the tension applying shaft 23. A pin 30 extending from the shaft portion 21*a* of the rotary base 21 is engaged with the groove 23*a*. With this arrangement, a rotational force can be transmitted to the shaft 23 while the shaft 23 can slide in the axial direction. Therefore, a tension can be applied to the tension applying shaft 23 in a direction indicated by a thick arrow so as to set the tension of the polishing plate 12 constant even while the shaft 23 is rotated.

A material for the polishing plate 12 used in this embodiment is a cellulose resin containing a fiber element as a major component, or a composite resin containing a cellulose resin. The fiber element contains cellulose as a matrix In this case, the cellulose resin containing a fiber element as a major component, which contains cellulose as a matrix, is a resin-like material containing a fiber element consisting of cellulose as a matrix. This material is preferably obtained by blending 10 to 50 wt % of camphor and 20 to 60 wt % of ethanol with 10 to 90 wt % of fiber elements.

In addition, in this case, the fiber element consisting of cellulose as a matrix is cellulose nitrate, cellulose acetate, or the like. Such a fiber element contains a hydroxyl group as a functional group as indicated by the following chemical formula:

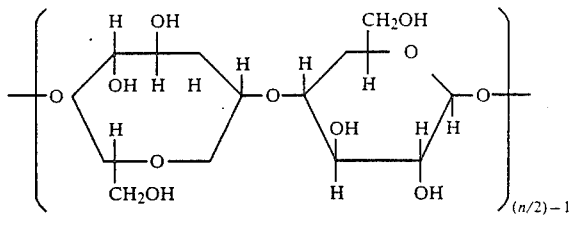

Therefore, the cellulose resin containing such a fiber element as a major component has very good wettability with respect to water. In spite of the fact that the above resin contains a hydroxyl group, it is not dissolved in water but slightly swelled in an alkali. In contrast to this, since conventionally used polyvinyl chloride, nylon, and fluorine hard resins contain no hydroxyl group, they are poor in wettability. For example, their contact angles as a measure of wettability are compared. The cellulose resin used in the present invention has a contact angle of about 60°, whereas a polyvinyl chloride resin has a contact angle of 87°; a nylon resin, 70°; and a fluoroplastic, 90° or more. As described above, the cellulose resin used in the present invention has good wettability unlike the conventional resins. Since the polishing plate 12 consists of the above cellulose resin, a uniform effect of an abrasive liquid 115 can be expected with respect to a surface to be processed, thus obtaining good processing characteristics. Note that the polishing plate 12 preferably has a surface roughness of 2 to 50 μm.

The composite resin containing a cellulose resin is a cellulose resin containing a powder and particles of one of a nylon resin, a foamed polyurethane resin, a vinyl chloride resin, and a fluoroplastic, or a resin containing 20 wt % or less of a fiber.

In this case, an abrasive liquid 115 which contains water or a small amount of surfactant contains particles of diamond, alumina, silicon oxide, iron oxide, cerium oxide, zirconium oxide, or the like.

The polishing plate 12 consisting of such an elastic member is rotated by the motor 100. An optical fiber connector 110 is then urged against the V-shaped or earthenware-like inclined surface of the polishing plate 12 supported by the outer and inner cylinders 25 and 26, and is polished while the abrasive liquid 115 is fed from a nozzle 116. At this time, the connector 110 is urged against the polishing plate 12 while it is rotated about its central axis. As a result, the connector 110 is polished into a curved surface.

Figure 3:
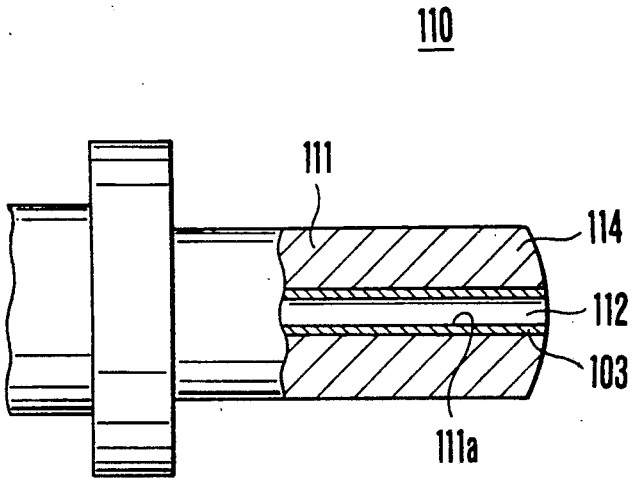
FIG. 3 is a partially cutaway side view showing an optical fiber connector in FIG. 1 in more detail.
Figure 8:
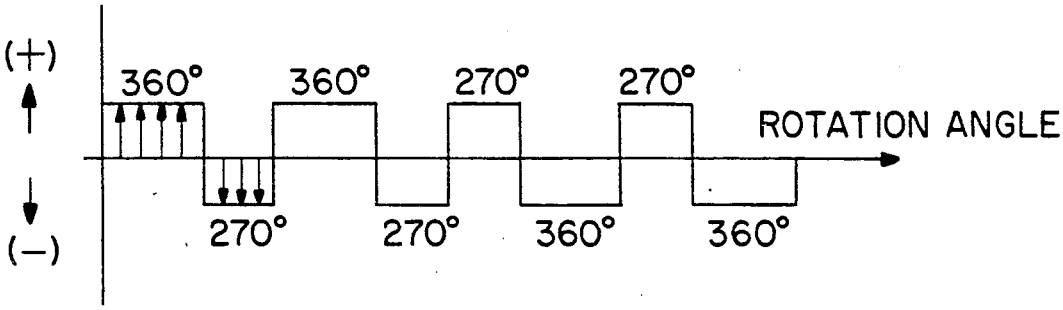
FIG. 8 is a view showing a control pattern for forward/reverse rotation driving of an object to be processed.

As shown in FIG. 3, this optical fiber connector 110 houses an optical fiber 112 in a through hole 111*a* formed at the center of a ferrule 111. The optical fiber 112 is fixed by an adhesive agent: Reference numeral 114 denotes an end face of the ferrule 111. An end of the optical fiber 112 slightly extends outward from the ferrule 111 and is brought into contact with the polishing plate 12 so as to be polished. The optical fiber connector 110 having the above arrangement is fixed and held by a connector chuck 126. The connector chuck 126 is coupled to the shaft of a pulse motor 123 through a belt 125 and a pulley 124. The pulse motor 123 is controlled by a control circuit 120 constituted by a computer 121 and a pulse motor driver 122. The pulse motor 123 periodically rotate the optical fiber connector 110 in the forward and reverse directions in accordance with a predetermined control pattern, as shown in FIG. 8. More specifically, the number of pulses in the forward and reverse directions of the pulse motor 123 are controlled by the computer 121, thus controlling the rotational direction and angle of the optical fiber connector 110.

With this arrangement, since the polishing plate 12 consists of, e.g., an elastic resin film material, the plate 12 may be extended upon swelling due to the abrasive liquid 115, may contracts due to drying, or may be elongated due to tension. Even if there is a factor of variation in tension due to such elongation/contraction of the material, since the central portion of the polishing plate 12 is displaced by the coil spring 31 and the tension applying shaft 23, a constant tension is always applied to the polishing surface of the inclined surface, thus performing constant polishing with good reproducibility and ensuring geometric precision.

Figure 2:
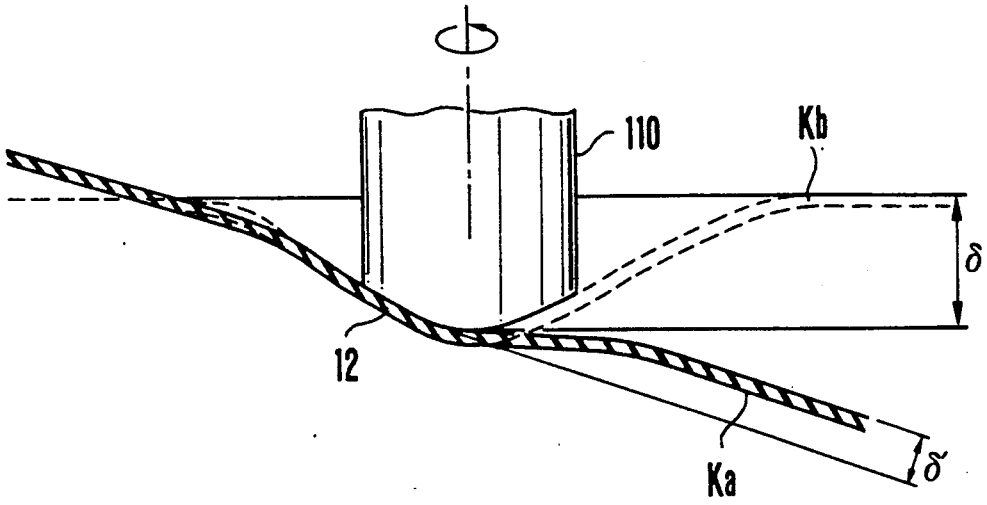
FIG. 2 is a view for explaining an operation of polishing by using the apparatus in FIG. 1.

FIG. 2 is a view for explaining polishing modes. Reference symbol Ka denotes a state wherein the polishing plate 12 has a V-shaped inclined surface; and Kb, a state wherein a conventional polishing plate has a flat surface.

Processing efficiency of the two modes will be described first. The feed efficiencies of the abrasive liquid 115 are different from each other. More specifically, when the polishing plate 12 is rotated at high speed, the abrasive liquid 115 is scattered in the circumferential direction because of a centrifugal force.

For this reason, as is apparent from FIG. 2, if the polishing plate 12 is set in the state Kb, the abrasive liquid 115 cannot easily flow between the optical fiber connector 110 and the polishing plate 12. However, if the polishing plate 12 is inclined as in the state Ka, the flow of the abrasive liquid 115 is promoted because of the fact that the abrasive liquid 115 flows along the inclined surface and the effect of a wedge defined between the end face of the connector 110 and the polishing plate 12, thus obtaining a high processing efficiency. With regard to processing modes, the end face of the connector 110 is flat in an initial period of polishing, and the entire edge portion of the end face of the connector 110 is polished in the state Kb of the polishing plate 12. In contrast to this, according to the mode wherein the polishing plate 12 is in the state Ka, since part of the edge portion of the end face of the connector 110 is polished, a high processing pressure is locally generated, a high processing efficiency can be obtained due to the synergetic effect of the high feed efficiency of the abrasive liquid 115.

In order to obtain a predetermined curvature radius by inclining the polishing plate 12 as in the state Kb, the connector 110 is moved downward by a depth denoted by reference symbol $\delta$ in FIG. 2. With an increase in indentation depth, stress on the polishing plate 12 is increased, thereby greatly damaging and wearing the polishing plate 12. In contrast to this, in the mode wherein the polishing plate 12 is set in the state Ka, in order to obtain the same curvature radius, a small indentation depth $\delta'$ is required as shown in FIG. 2, thereby improving durability and wear resistance.

Figure 4:
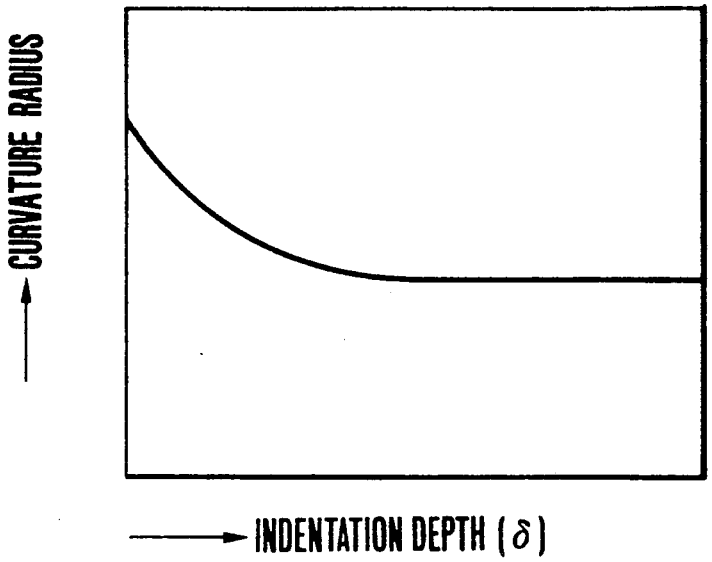
FIG. 4 is a graph showing curvature radius/indentation depth characteristics when a conventional flat polishing plate is used.
Figure 5:
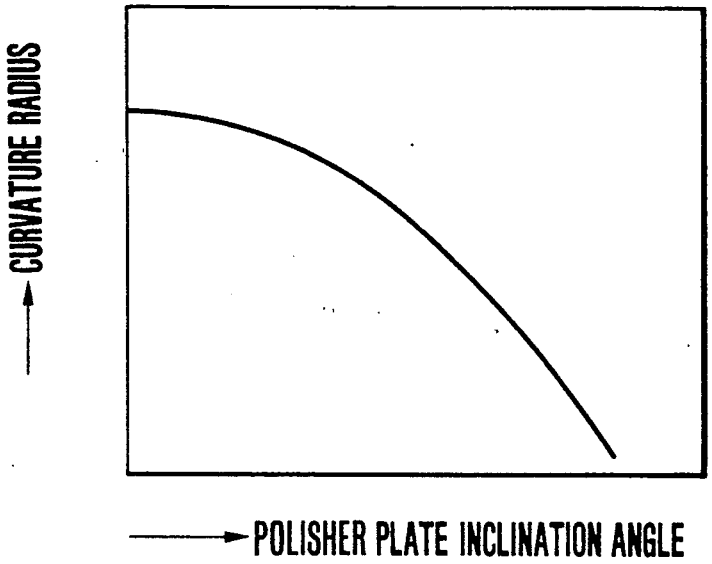
FIG. 5 is a graph showing curvature radius/polishing plate inclination angle characteristics when an inclined polishing plate of the present invention is used.

Controllability of the curvature radius will be described below. FIG. 4 shows an experiment result when the conventional flat polishing plate is used as indicated by the state Kb. In this case, the curvature radius is controlled by an indentation depth of the connector 110 urged against the polishing plate surface. When the indentation depth exceeds a given value, the strength of the polishing plate material falls in its plastic deformation range. For this reason, a small curvature radius cannot be obtained. FIG. 5 shows controllability of the curvature radius when the polishing plate 12 of this embodiment is used in the state Ka. The curvature radius can be changed in a wide range by only changing the inclination angle (conical angle) of the polishing plate 12.

The fiber connector 110 is rotated in the forward and reverse directions in this manner for the following reason.

It is already known that when an object to be processed is urged against an elastic polishing plate rotating at high speed so as to be polished, a pressure distribution at the contact surface between the polishing plate and the object varies depending on positions at the contact surface.

Figure 6A:
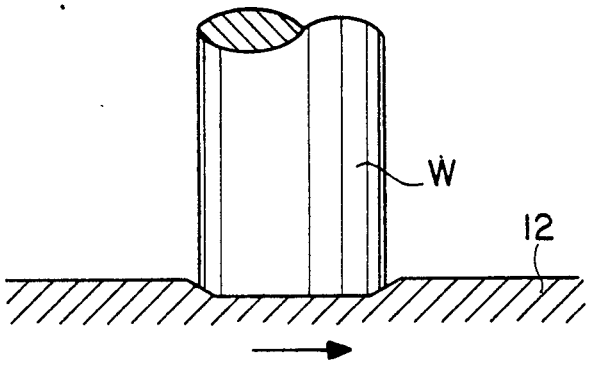
FIG. 6(A) PRIOR ART
FIGS. 6A and 6B are views each showing a pressure distribution at a contact portion between a polishing plate and an object to be processed according to one of the conventional techniques.
Figure 6B:
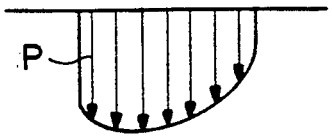
FIG. 6(B) PRIOR ART

FIGS. 6A and 6B are views for explaining this phenomenon. FIG. 6A shows a state wherein the connector 110 is urged against the elastic polishing plate 12. FIG. 6B shows a distribution of pressure P at the contact surface. Referring to FIG. 6A, when the polishing plate 12 is rotated at high speed in a direction indicated by an arrow in FIG. 6A, the pressure distribution at the contact surface between the polishing plate 12 and an object W to be processed becomes large at the inlet side and tends to be decreased toward the outlet side, as shown in FIG. 6B. Since processing efficiency in polishing is proportional to a pressure, it is apparent that if polishing is performed in the state shown in FIG. 6A, central symmetry is lost. For this reason, in this embodiment, in polishing the end face of the optical fiber connector 110, the connector 110 is rotated in the forward and reverse directions to obtain central symmetry and to reduce eccentricity.

Figure 7A:
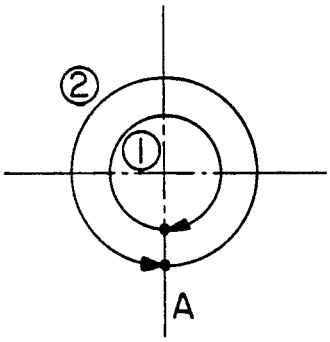
FIG. 7(A) PRIOR ART
FIGS. 7A and 7B are views showing ways of giving forward/reverse rotation to an optical fiber connector according to a conventional system and the present invention.
Figure 7B:
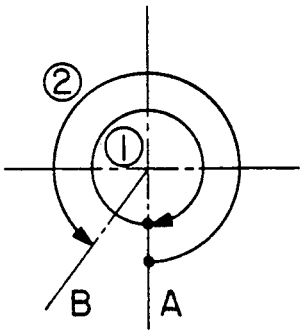

FIGS. 7A and 7B are views for explaining a scheme of rotating the optical fiber connector in the forward and reverse directions. FIG. 7A shows a conventional scheme. FIG. 7B shows a scheme of providing forward/reverse rotation according to the present invention. As shown in FIG. 7A, in the conventional scheme, a rotational angle of 360° or more is normally provided, and a forward rotational angle ① is equal to a reverse rotational angle ②. Therefore, a reverse position is always at a position A, and this positional relationship is always maintained. As the connector 110 is stopped at the time of reverse rotation, eccentricity occurs due to the difference in processing efficiency as described with reference to FIGS. 6A and 6B.

FIG. 7B shows a processing method according the present invention. Since a difference in rotational angle is set between a forward rotational angle ① and a reverse rotational angle ②, a reverse position which is initially set at a position A is moved to a position B corresponding to the angle difference after one cycle of forward/reverse rotation. The reverse position is moved by repeating this cycle. When the reverse position reaches a position of 180° or 360° with respect to the position A, if the forward rotational angle ① and the reverse rotational angle ② are reversed, and forward/reverse rotation is performed by cycles equal in number to cycles of the preceding rotation, the reverse position returns to the position A. In this manner, polishing is performed by continuously rotating the fiber connector in such a manner that the reverse position is always moved from an immediately preceding position without stopping at a given position. Therefore, eccentricity which is caused as the connector stops at the reverse position can be greatly reduced, and the end face of the optical fiber connector 110 can be processed with high precision.

An example of this operation will be described below with refence to FIG. 8. Referring to FIG. 8, arrows represent continuous driving pulses to be supplied to the pulse motor 123 shown in FIG. 1 and their directions, and the axis of abscissa represents a rotational angle. A method of driving the pulse motor 123 will be described below. When the rotational angle of the connector chuck 126 is rotated through 360° in the forward direction (+ in FIG. 8), and is rotated through 270° in the reverse direction (− in FIG. 8), the reverse position is shifted from the initial position by 90°. If the same operation is performed, the reverse position is shifted from the initial position by 180°. When the forward and reverse rotational angles are reversed, and two operations of rotation are performed, the reverse position returns to the initial position. These preceding operations are considered as one cycle. If this cycle is repeated, the reverse position is alternately moved to the positive and negative directions, so that the connector chuck 126 is continuously operated for a predetermined polishing period.

If the end of the optical fiber connector 110 is polished by performing the above operation, since the reverse position is sequentially moved, accumulation of eccentricity can be prevented. In addition, by changing the reverse position, directivity of eccentricity can be canceled, and hence eccentricity can be kept to be very small. When polishing was actually performed by employing the forward/reverse rotating operation according to the present invention, it was found that eccentricity which was 100 μm or more in the conventional polishing method was reduced by at least 1/5 to 1/10, and hence high-precision processing was realized.

In the above-described embodiment, the forward and reverse rotational angles are set to be 360° and 270°, respectively. However, a combination of rotational angles is not limited to this. For example, a rotational angle exceeding 360° may be used. The same effects can be obtained by using an arbitrary combination of rotational angles. In addition, in the above description, the reverse position is sequentially moved. However, the same effects can be obtained by performing a forward-/reverse rotating operation in such a manner that reverse positions are dispersed at arbitrarily positions on a circumference.

In the above embodiment, the peripheral portion of the polishing plate 12 and the outer and inner cylinders 25 and 26 are fixed on the rotary base 21, and the central portion of the polishing plate 12 can be moved in the axial direction. However, the central portion of the polishing plate 12 and the outer and inner cylinders 25 and 26 may be fixed on the rotary base 21, so that the peripheral portion of the polishing plate 12 can be moved in the axial direction. Alternatively, the outer and inner cylinders 25 and 26 may be fixed on the rotary base 21, and the peripheral and central portions of the polishing plate 12 may be displaced in the axial direction. In addition, the peripheral and central portions of the polishing plate 12 may be fixed on the rotary base 21, and one of the outer and inner cylinders 25 and 26 is fixed on the rotary base 21, so that one of the cylinders can be axially moved. Moreover, both the outer and inner cylinders 25 and 26 may be set to be movable in the axial direction so as to apply a tension to the polishing plate 12.

Figure 9:
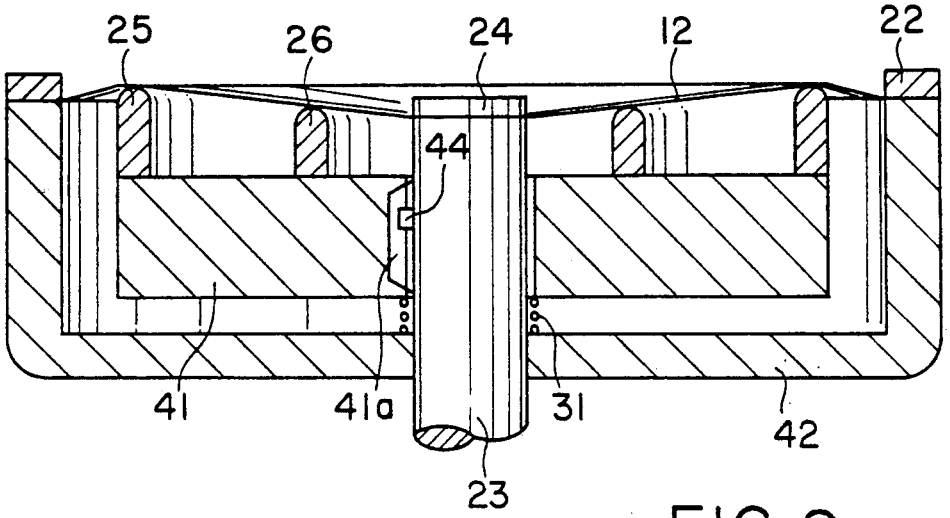
FIGS. 9 and 10 are sectional views showing modifications of the present invention.

FIG. 9 shows an embodiment wherein a rotary base 42 and a tension applying shaft 23 are integrally formed, and outer and inner cylinders 25 and 26 can be moved together in the axial direction of the rotary base 42 and the shaft 23. As shown in FIG. 9, the lower ends of the outer and inner cylinders 25 and 26 are fixed on the rotary base 41, and a polishing plate 12 is supported by their upper end faces from the lower direction. The rotary base 42 and the tension applying shaft 23 are integrally formed, and a coil spring 31 is interposed between rotary bases 41 and 42 which have a shaft 43 extending through the central portions. In addition, a groove 41*a* similar to the groove 23*a* (see FIG. 1) is formed in the rotary base 41, and a pin 44 similar to the pin 30 (see FIG. 1) is fixed to the shaft 43.

The inclination of the polishing plate 12 can be arbitrarily selected by changing the heights of the portions supporting the peripheral and central portions of the polishing plate 12 with respect to the rotary base 21, and properly changing the levels of the free support points of the polishing plate 12 defined by the outer and inner cylinders 25 and 26.

Figure 10:
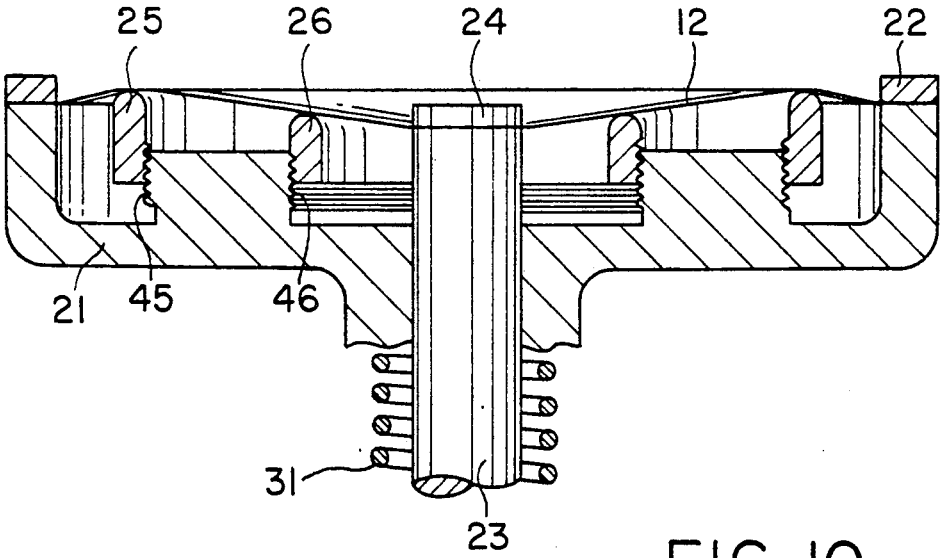

FIG. 10 shows an embodiment wherein the levels of the free support points of a polishing plate 12, defined by outer and inner cylinders 25 and 26, can be adjusted. As shown in FIG. 10, annular male thread portions 45 and 46 with which outer and inner cylinders 25 and 26 are threadably engaged are formed in a rotary base 21, so that the positions of the upper end faces of the outer and inner cylinders 25 and 26 can be adjusted by changing their insertion amounts with respect to the male thread portions 45 and 46.

In the above embodiment, the surface of the polishing plate 12 gradually descends toward its center to form a conical surface. However, the surface may gradually descend toward its peripheral portion to form an inverted conical surface. This structure will be described in detail with reference to FIG. 1. A tension applying shaft is biased downward by a spring as indicated by the thick arrow in FIG. 1, so that a central portion of the polishing plate 12 is set at a higher position than its peripheral position so as to form a conical section. In this case, an outer cylinder 25 is lower in height than an inner cylinder 26, and both their upper surfaces are set in contact with the lower surface of the polishing plate 12.

As has been described above, according to the present invention, high processing efficiency can be obtained because of the synergetic effects of the polishing mode and the feed efficiency of abrasive liquid. The curvature radius of a rod end face can be arbitrarily controlled in a wide range by changing the inclination of a polishing plate. In addition, by employing the means of applying a tension to the both outer and inner cylinders having different diameters and the polishing plate, a constant tension can always be applied to the polishing surface of the polishing plate. Therefore, stable polishing with excellent reproducibility can be performed, and geometric precision can be ensured. Furthermore, in the above embodiments, the present invention is applied to processing of a connector end face. However, the same effects can be obtained if the present invention is applied to various fields of processing other than processing of rod members, e.g., processing of glass such as an optical lens, crystals, metals, and ceramics.

In the above embodiment, the heights of the cylinders 25 and 26 are different from each other. However, these heights may be equal to each other.

What is claimed is:

1. A method of forming a curved surface comprising the steps of: rotating a polishing plate consisting of a film-like elastic member which is supported at two positions, i.e., central and peripheral portions thereof, while two cylinders, outer and inner cylinders having different heights and diameters, are urged upward against portions between the central and peripheral portions of said polishing plate; and urging an object to be processed downward against a surface of said polishing plate formed between said two cylinders while the object is rotated, thereby forming a curved surface.

2. A method according to claim 1, wherein said surface between said two cylinders is an inclined surface.

3. A method according to claim 1, wherein the peripheral portion of said polishing plate is fixed, and the central portion thereof is spring-biased downward.

4. A method according to claim 1, wherein the peripheral portion of said polishing plate is fixed on a rotary base, and the central portion of said polishing plate is fixed to a shaft portion extending through a hole formed in a central portion of said rotary base, said shaft portion being spring-biased against said rotary base, and said outer and inner cylinders are arranged on said rotary base.

5. A method according to claim 1, wherein said polishing plate consists of a cellulose resin containing a fiber element as a major component, the fiber element containing cellulose as a matrix.

6. A method according to claim 5, wherein the cellulose resin is obtained by blending 10 to 50 wt % of camphor and 20 to 60 wt % of ethanol with 10 to 50 wt % of said fiber element.

7. A method according to claim 6, wherein the fiber element contains a hydroxyl group as a functional group.

8. A method according to claim 1, wherein said polishing plate consists of a composite resin containing a cellulose resin containing a fiber element as a major component, the fiber element containing cellulose as a matrix.

9. A method according to claim 8, wherein the composite resin is obtained by blending 20 wt % of an element selected from the group consisting of a nylon resin, a foamed urethane resin, a vinyl chloride resin, and a fluoroplastic with a cellulose resin.

10. A method according to claim 1, wherein while the object is urged against said polishing plate, an abrasive medium containing particles (abrasive grains) is fed to a contact surface between the object and said polishing plate.

11. A method according to claim 1, wherein the object is alternately rotated in forward and reverse directions.

12. A method according to claim 11, wherein a reverse position of forward rotation and reverse rotation is different from an immediately preceding reverse position.

13. A method according to claim 11, wherein the reverse position is shifted by setting rotational angles of forward rotation and reverse rotation to be different from each other.

14. A method according to claim 13, wherein the number of cycles of forward rotation is set to be equal to that of reverse rotation.

15. An apparatus for forming a curved surface, comprising:

a polishing plate consisting of a film-like elastic member;

a rotary plate for supporting a peripheral portion of said polishing plate;

two cylinders, outer and inner cylinders, on said rotary plate and having different heights and diameters;

means for spring-biasing a central portion of said polishing plate downward; and rotating means for rotating an object to be processed and urging the object against said polishing plate, thereby a curved surface is formed on the object.

16. An apparatus according to claim 15, wherein a surface of said polishing plate between said two cylinders is an inclined surface.

17. An apparatus according to claim 15, wherein said rotary plate comprises a shaft portion having a through hole formed in a central portion thereof, and said means for spring-biasing comprises a tension applying shaft extending from the central portion of said polishing plate to a lower position through the through hole of said rotary plate, and a spring for biasing said tension applying shaft against said shaft portion of said rotary plate.

18. An apparatus according to claim 15, wherein at least one of said two cylinders is positioned by a positioning member formed on said rotary plate.

19. An apparatus according to claim 15, further comprising means for feeding an abrasive medium containing particles (abrasive grains) to a contact surface between the object and said polishing plate.

20. An apparatus according to claim 15, wherein said rotating means comprises means for rotating the object in forward and reverse directions.

21. An apparatus according to claim 15, wherein said polishing plate consists of a cellulose resin containing a fiber element as a major component, the fiber element containing cellulose as a matrix.

22. An apparatus according to claim 21, wherein the cellulose resin is obtained by blending 10 to 50 wt % of camphor and 20 to 60 wt % of ethanol with 10 to 50 wt % of said fiber element.

23. An apparatus according to claim 22, wherein the fiber element contains a hydroxyl group as a functional group.

24. An apparatus according to claim 15, wherein said polishing plate consists of a composite resin containing a cellulose resin containing a fiber element as a major component, the fiber element containing cellulose as a matrix.

25. An apparatus according to claim 24, wherein the composite resin is obtained by blending 20 wt % of an element selected from the group consisting of a nylon resin, a foamed urethane resin, a vinyl chloride resin, and a fluoroplastic with a cellulose resin.

26. An apparatus according to claim 15, wherein said rotating means alternately repeats forward rotation and reverse rotation of the object.

27. An apparatus according to claim 26, wherein said rotating means changes a reverse position of forward rotation and reverse rotation from an immediately preceding reverse position.

28. An apparatus according to claim 26, wherein said rotating means shifts the reverse position by setting rotational angles of forward rotation and reverse rotation of the object.

29. An apparatus according to claim 28, wherein said rotating means sets the number of cycles of forward rotation to be equal to that of reverse rotation.

30. An apparatus according to claim 15, wherein said rotary plate comprises a first rotary base for supporting said outer and inner cylinders, and a second rotary base for supporting the peripheral portion of said polishing plate, and said means for biasing comprises a tension applying shaft extending from the central portion to a lower position through a through hole formed in said first and second rotary bases, and a spring, arranged between said first and second rotary bases, for biasing said tension applying shaft against said first rotary base.

31. An apparatus according to claim 15, wherein said outer and inner cylinders comprise means for adjusting heights of said outer and inner cylinders with respect to said rotary plate.

* * * * *